US006661310B2

(12) United States Patent
Okada et al.

(10) Patent No.: US 6,661,310 B2
(45) Date of Patent: Dec. 9, 2003

(54) DIELECTRIC DUPLEXER AND COMMUNICATION APPARATUS

(75) Inventors: Takahiro Okada, Kanazawa (JP); Jinsei Ishihara, Kanazawa (JP); Hideyuki Kato, Ishikawa-gun (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 35 days.

(21) Appl. No.: 10/033,763

(22) Filed: Dec. 28, 2001

(65) Prior Publication Data

US 2002/0097113 A1 Jul. 25, 2002

(30) Foreign Application Priority Data

Jan. 22, 2001 (JP) ..... 2001-013601
Nov. 7, 2001 (JP) ..... 2001-342004

(51) Int. Cl.[7] ..... H01P 1/213
(52) U.S. Cl. ..... 333/134; 333/202; 333/206
(58) Field of Search ..... 333/134, 202, 333/206, 222

(56) References Cited

U.S. PATENT DOCUMENTS 4,546,333 A 10/1985 Fukasawa et al.
5,929,721 A * 7/1999 Munn et al. ..... 333/134
5,929,725 A * 7/1999 Toda et al. ..... 333/202
6,002,307 A * 12/1999 Arakawa ..... 333/135

FOREIGN PATENT DOCUMENTS

| | | |
|---|---|---|
| EP | 0783 188 A | 7/1997 |
| EP | 0 926 759 A | 6/1999 |
| EP | 1 067 620 A | 1/2001 |

* cited by examiner

*Primary Examiner*—Robert Pascal
*Assistant Examiner*—Dean Takaoka
(74) *Attorney, Agent, or Firm*—Dickstein, Shapiro, Morin & Oshinsky, LLP.

(57) ABSTRACT

A dielectric duplexer includes a substantially rectangular dielectric block. The dielectric block includes inner-conductor-containing holes each having an inner conductor on the inner surfaces thereof, and inner-conductor-unformed portions on which the inner conductors are not formed are formed in the vicinity of first ends of the inner-conductor-containing holes. The dielectric block further includes an outer conductor and input/output electrodes which are formed on the outer surface thereof, and the input/output electrodes are separated from the outer conductor. A through-hole having a short circuited electrode formed on the inner surface thereof is provided between two of the inner-conductor-containing holes so as to run from the mounting surface to the surface opposite thereto.

6 Claims, 9 Drawing Sheets

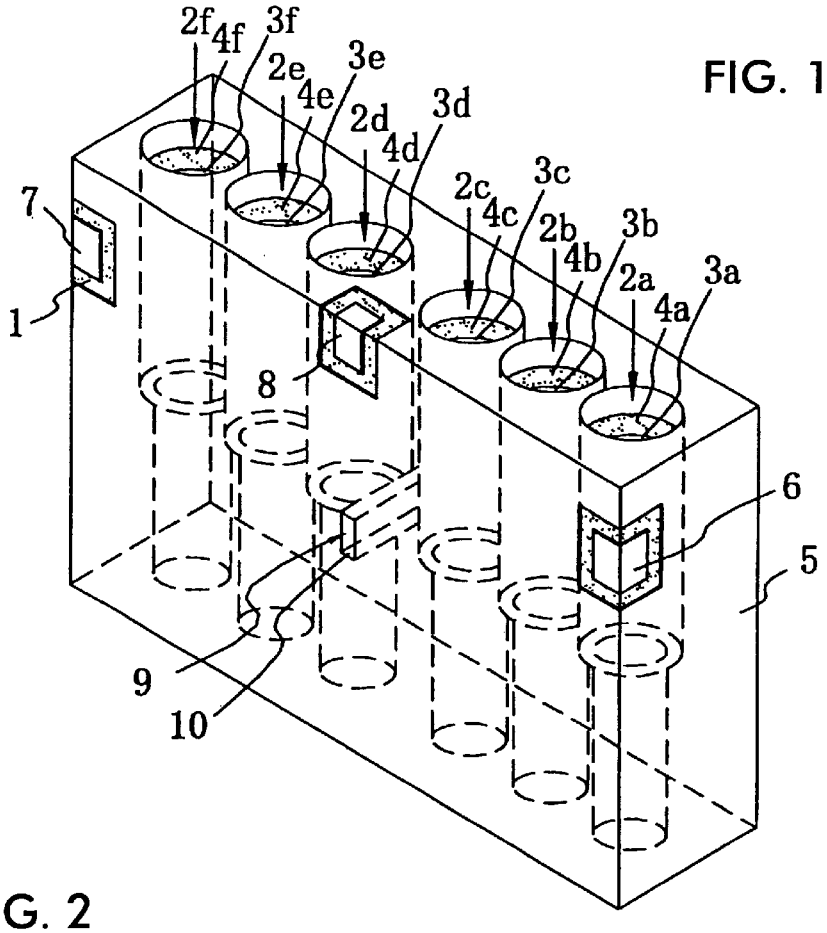
FIG. 1
FIG. 2
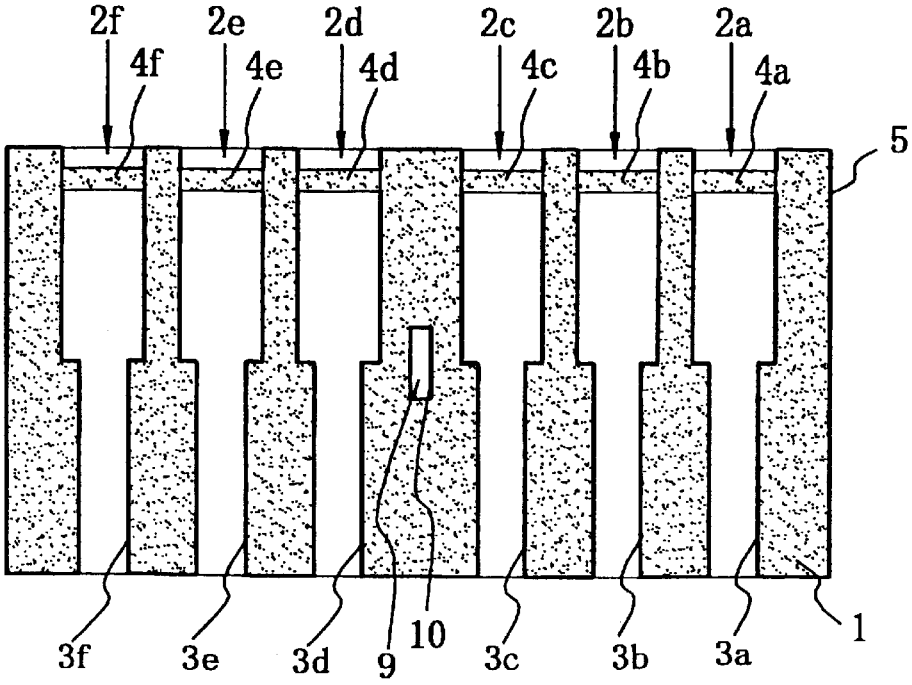

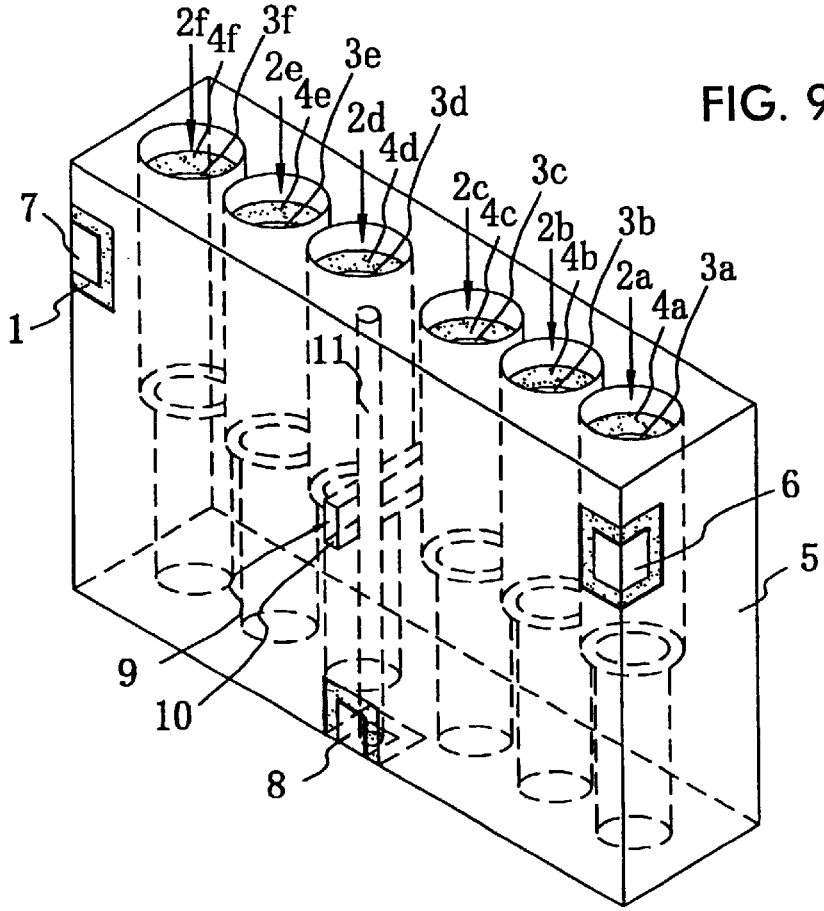
FIG. 9A
FIG. 9B
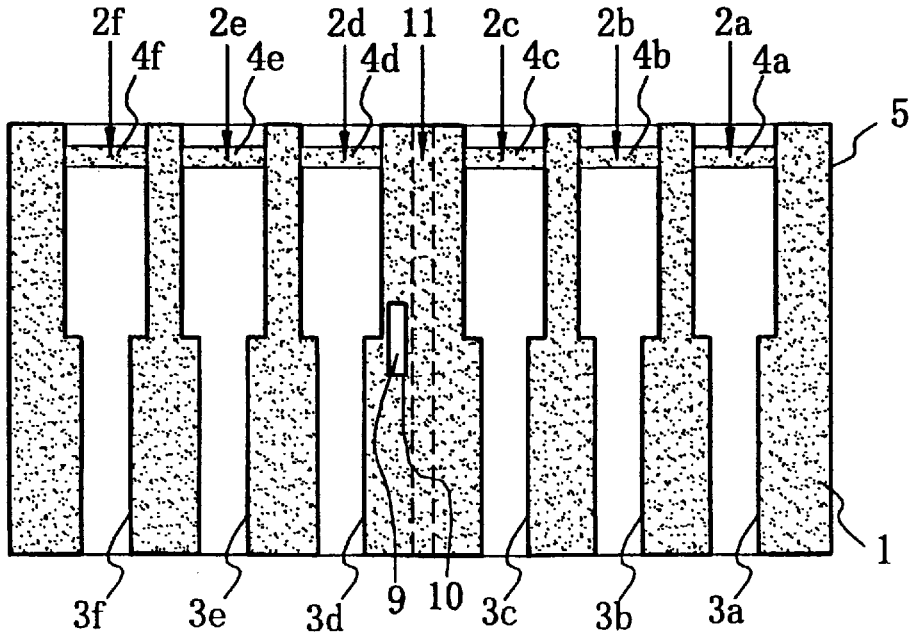

DIELECTRIC DUPLEXER AND COMMUNICATION APPARATUS

BACKGROUND OF THE INVENTION

1. Field of the Invention

The present invention relates to a dielectric duplexer mainly used in the microwave band, and a communication apparatus using the same.

2. Description of the Related Art

A typical dielectric duplexer is described with reference to FIG. 11.

FIG. 11 is a perspective view of the appearance of a typical dielectric duplexer.

Referring to FIG. 11, a substantially rectangular dielectric block 1 includes inner-conductor-containing holes 2*a* to 2*f* having inner conductors 3*a* to 3*f* formed on the inner surfaces thereof, respectively, and an outer conductor 5 formed on the entire outer surface thereof. Inner-conductor-unformed portions 4*a* to 4*f* on which the inner conductors 3*a* to 3*f* are not formed are formed in the vicinity of first ends of the inner-conductor-containing holes 2*a* to 2*f*, and the first ends are open. Second ends that are opposite to the first ends are short circuited. Thus, dielectric resonators are constructed. Each of the inner-conductor-containing holes 2*a* to 2*f* is stepped so that the open end side has a larger inner diameter than the short circuited end side.

On the outer surface of the dielectric block 1, input/output electrodes 6 and 7, which are separated from the outer conductor 5, are formed so as to extend from the end surfaces in the alignment direction of the inner-conductor-containing holes 2*a* to 2*f* to the mounting surface that faces the mounting substrate. On the outer surface of the dielectric block 1, an input/output electrode 8, which is separated from the outer conductor 5, is further formed between the inner-conductor-containing holes 2*c* and 2*d* so as to extend from the open end surface of the inner-conductor-containing holes 2*a* to 2*f* to the mounting surface. With this structure, a first group of the inner-conductor-containing holes 2*a* to 2*c*, and a second group of the inner-conductor-containing holes 2*d* to 2*f* each form a three-stage dielectric filter having a coupling capacitor, thereby forming a dielectric duplexer as a whole.

Specifically, the dielectric block 1, the inner conductors 2*a* to 2*f*, and the outer conductor 5 constitute TEM (transverse electromagnetic) mode resonators, and the TEM mode resonators are combline-coupled with each other by means of stray capacitance generated in the inner-conductor-unformed portions 4*a* to 4*f* to form dielectric filters. The plurality of dielectric filters are combined to form a dielectric duplexer. The dielectric duplexer has attenuation poles (coupling poles) because of coupling between the resonators. The attenuation poles can be used to provide a sharp attenuation characteristic from the pass band to the cut-off band near a low frequency region or from the pass band to the cut-off band near a high frequency region.

However, such a typical dielectric duplexer has encountered a problem to be overcome.

In a dielectric duplexer having a substantially rectangular dielectric block and an outer conductor formed on the outer surface thereof, a resonance mode other than a basic resonance mode or a TEM mode, including a $TE_{101}$ mode, may be generated by the dielectric block and the outer conductor. Once a resonance mode different from a basic resonance mode, such as a TE mode, is generated, the dielectric duplexer will increase spurious responses.

In order to overcome such a problem, approaches which have been contemplated are (1) to modify the dimensions of a dielectric duplexer to offset the resonant frequency of a TE mode, and (2) to separately provide a transmission filter and a reception filter which are combined so that the influence of a TE mode on the dielectric duplexer may be reduced.

In approach (1), the dimensions of the dielectric duplexer must be defined with consideration of a TE mode, and a filter design accommodating a TEM mode is required. Furthermore, since a compact dielectric duplexer is desirable in the current state, there are limitations to variable dimensions, leading to less flexibility in design.

In approach (2), since two components are required for a transmission filter and a reception filter, the number of circuit components increases, resulting in increased production cost. The transmission filter and the reception filter are bonded by soldering, thereby reducing reliability.

SUMMARY OF THE INVENTION

Accordingly, it is an object of the present invention to provide a dielectric duplexer which eliminates or reduces the influence of a TE mode and has low spurious responses without the need to modify the dimensions or connect additional components, and to provide a communication apparatus using the dielectric duplexer.

To this end, in one aspect of the present invention, a dielectric duplexer includes:

a dielectric block;

a plurality of inner-conductor-containing holes formed in the dielectric block, each hole having an inner conductor formed on the inner surface thereof, the inner-conductor-containing holes extending from one surface to another surface opposite thereto of the dielectric block;

an outer conductor and an input/output terminal which are formed on the outer surface of the dielectric block, the input/output terminal being separated from the outer conductor; and at least one short circuited conductor formed between the plurality of inner-conductor-containing holes on a transmitter side and the plurality of inner-conductor-containing holes on a receiver side, said at least one short circuited conductor extending from one surface that is parallel to the axes of the inner-conductor-containing holes to another surface opposite thereto and conductively coupled to said outer conductor.

Therefore, the dielectric duplexer is affected less by a TE mode and has low spurious responses.

The dielectric block may include an excitation hole for an antenna, and the at least one short circuited conductor preferably intersects the excitation hole. Therefore, the dielectric duplexer has low spurious responses.

In another aspect of the present invention, a communication apparatus incorporates the dielectric duplexer, thereby achieving the desired communication characteristics.

BRIEF DESCRIPTION OF THE DRAWINGS

Other features and advantages of the present invention will become apparent from the following description of the invention which refers to the accompanying drawings.

FIG. 1 is a perspective view of the appearance of a dielectric duplexer according to a first embodiment of the present invention;

FIG. 2 is a cross-sectional view of the dielectric duplexer shown in FIG. 1;

FIGS. 9A and 9B are a perspective view and a cross-sectional view of the appearance of a modified dielectric duplexer according to the third embodiment, respectively;

DETAILED DESCRIPTION OF EMBODIMENTS OF THE INVENTION

A dielectric duplexer according to a first embodiment of the present invention is described with reference to FIGS. 1 to 4.

FIG. 1 is a perspective view of the appearance of the dielectric duplexer, and FIG. 2 is a cross-sectional view of the dielectric duplexer shown in FIG. 1.

Figure 3A:
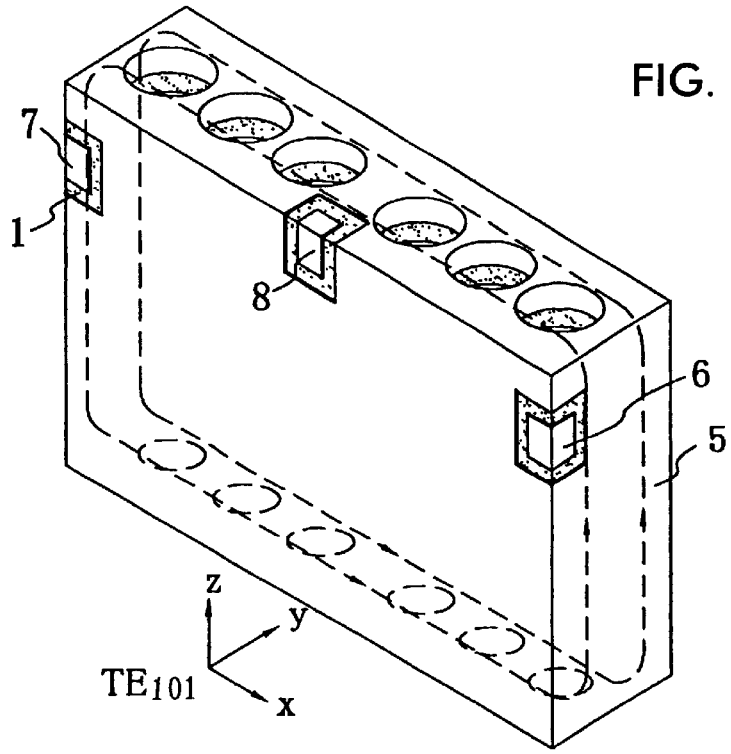
FIGS. 3A and 3B are views each showing the magnetic field vector of a TE mode which is generated in a dielectric duplexer.
Figure 3B:
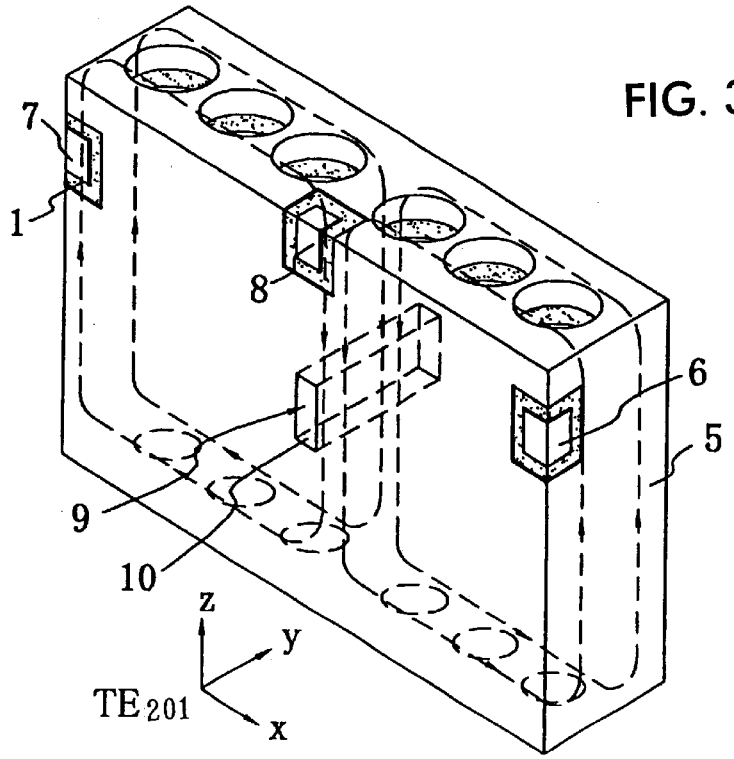

FIG. 3A shows the magnetic field vector of a TE mode which is generated in a typical dielectric duplexer, and FIG. 3B shows the magnetic field vector of a TE mode which is generated in the dielectric duplexer according to the first embodiment which includes a through-hole having a short circuited electrode formed on the inner surface thereof.

Figure 4A:
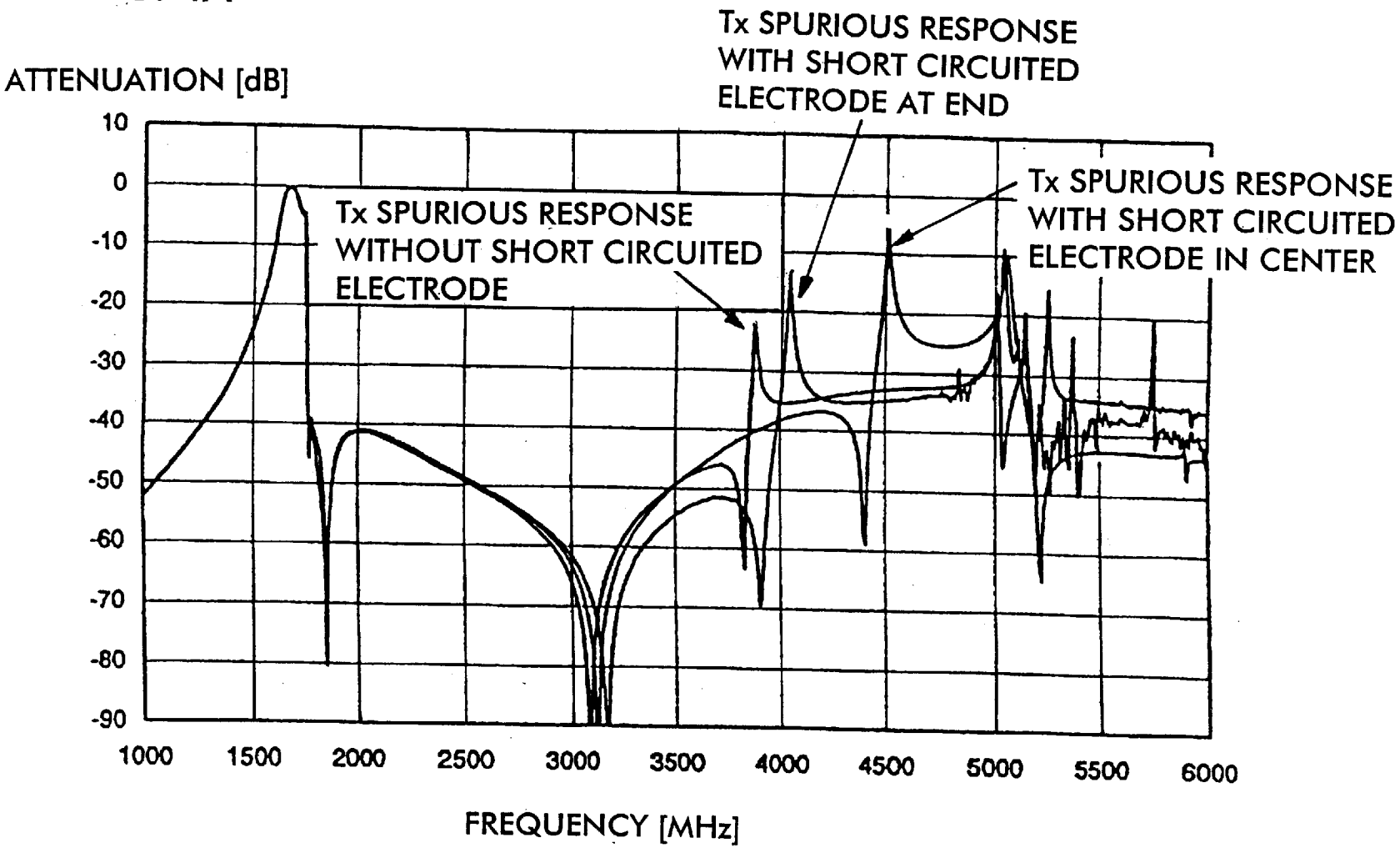
FIGS. 4A and 4B are graphs showing spurious responses of the dielectric duplexer according to the first embodiment.
Figure 4B:
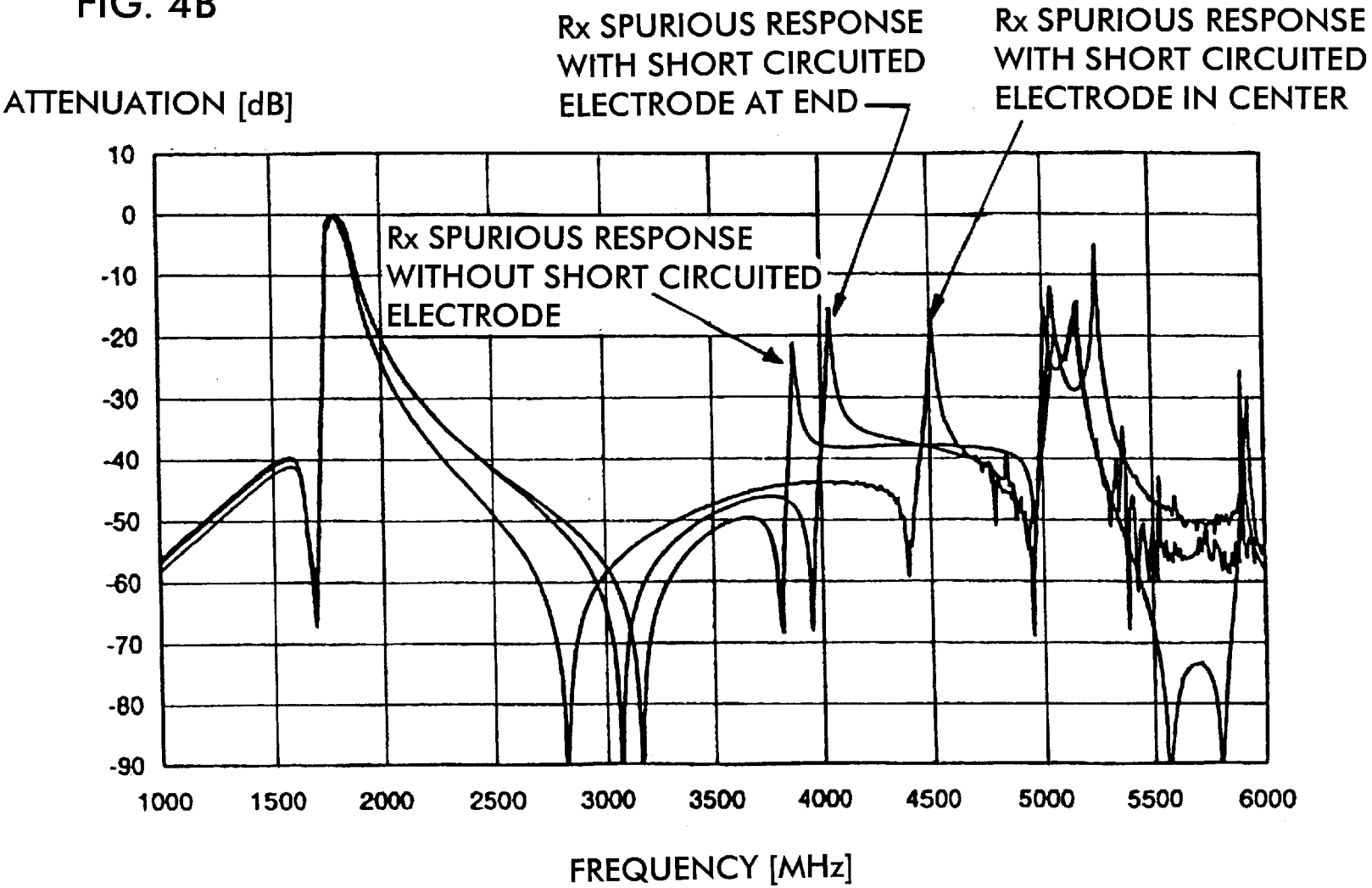

FIGS. 4A and 4B are spurious response charts of the dielectric duplexer.

Referring to FIGS. 1 and 2, a substantially rectangular dielectric block 1 includes inner-conductor-containing holes 2*a* to 2*f* having inner conductors 3*a* to 3*f* formed on the inner surfaces thereof, respectively, and an outer conductor 5 formed on the substantially entire outer surface thereof. Inner-conductor-unformed portions 4*a* to 4*f* on which the inner conductors 3*a* to 3*f* are not formed are formed in the vicinity of first ends of the inner-conductor-containing holes 2*a* to 2*f*, and the first ends are open. Second ends that are opposite to the first ends are short circuited. Thus, dielectric resonators are constructed. Each of the inner-conductor-containing holes 2*a* to 2*f* is stepped so that the open end side has a larger inner diameter than the short circuited end side.

On the outer surface of the dielectric block 1, input/output electrodes 6 and 7, which are separated from the outer conductor 5, are formed so as to extend from the end surfaces in the alignment direction of the inner-conductor-containing holes 2*a* to 2*f* to the mounting surface which faces the mounting substrate. On the outer surface of the dielectric block 1, an input/output electrode 8 which is separated from the outer conductor 5 is further formed between the inner-conductor-containing holes 2*c* and 2*d* so as to extend from the open end surface of the inner-conductor-containing holes 2*a* to 2*f* to the mounting surface.

The input/output electrode 6 is capacitively coupled with the inner conductor 3*a*, and the input/output electrode 7 is capacitively coupled with the inner conductor 3*f*. The input/output electrode 8 is capacitively coupled with the inner conductors 3*c* and 3*d*.

With this structure, a first group of the inner-conductor-containing holes 2*a* to 2*c*, and a second group of the inner-conductor-containing holes 2*d* to 2*f* act as first and second three-stage comb-line dielectric filters, respectively. An apparatus which uses the first comb-line dielectric filter as a transmission filter and the second comb-line dielectric filter as a reception filter would act as a dielectric duplexer in which the input/output electrodes 6, 7, and 8 typically serve as a transmission signal input terminal, a reception signal output terminal, and an antenna terminal, respectively.

As shown in FIGS. 1 and 2, a through-hole 9 having a short circuited electrode 10 formed on the inner surface thereof is provided in the center of the dielectric block 1 between the inner-conductor-containing holes 2*c* and 2*d* so as to run from the mounting surface (the left hand surface in FIG. 1) to the surface opposite (the right hand or rear surface in FIG. 1) thereto.

In the thus constructed dielectric duplexer, the electric field is short circuited by the short circuited electrode 10 in the location where the electric field energy of a $TE_{101}$ mode shown in FIG. 3A is most highly concentrated. As a result, a $TE_{101}$ mode is not substantially generated or excited. As shown in FIG. 3B, a $TE_{201}$ mode is not substantially affected by the short circuited electrode 10, and is not suppressed but may be sometimes rather enhanced. The resonant frequency of a $TE_{201}$ mode is inherently higher than the resonant frequency of a $TE_{101}$ mode, and the influence of a TE mode on the frequency band used is reduced, resulting in reduced spurious responses.

It is not necessary for the through-hole 9 containing the short circuited electrode 10 to be provided in the center of the dielectric block 1, and the through-hole 9 may be alternatively provided in the vicinity of an end surface, if desired. Rather than a single through hole, a plurality of through-holes may be provided.

FIGS. 4A and 4B are graphs showing spurious responses for transmission and reception in a dielectric duplexer having a dimension of 10×6×2 mm. Each graph exhibits characteristics when the short circuited electrode 10 is not included, when the short circuited electrode 10 is inserted in the center, and when the short circuited electrode 10 is inserted in an end portion.

As is apparent from FIGS. 4A and 4B, a $TE_{101}$ mode is generated in the vicinity of 3.8 GHz when the short circuited conductor is not included. On the other hand, the peak frequency can be shifted to the vicinity of 4.1 GHz when the short circuited conductor is inserted in an end portion, or to the vicinity of 4.5 GHz when the short circuited conductor is inserted in the center, where an attenuation amount increases in a range between 3.6 GHz and 3.9 GHz. Therefore, as a short circuited conductor is provided in closer proximity to the center, the peak frequency is shifted to a higher frequency region.

In the dielectric duplexer according to the first embodiment with reference to FIGS. 1 to 3, the input/output electrodes 6 to 8 are capacitively coupled with predetermined inner conductors; however, other types of input/output units may also be used. For example, excitation holes are formed at outer positions than the outermost inner-conductor-containing holes 2*a* and 2*f* so as to be parallel to the inner-conductor-containing holes 2*a* and 2*f*. An excitation hole is further formed between the inner-conductor-containing holes 2*c* and 2*d* so as to be parallel to the inner-conductor-containing holes 2*c* and 2*d*. Then, input/output electrodes which conduct to conductors contained in the excitation holes are formed so as to extend from the mounting surface to the open end surface of the inner-conductor-containing holes 2*a* to 2*f*.

In this case, the excitation holes are interdigital coupled with the resonators formed by the associated inner-conductor-containing holes which are adjacent to the excitation holes.

One or two of the three input/output electrodes may be externally coupled through the excitation holes.

Besides the external coupling through the excitation holes, trap resonators may be provided. More specifically, inner-conductor-containing holes having the same structure as that of the inner-conductor-containing holes 2*a* to 2*f* are formed in outwardly of the outer position than the excitation holes which are coupled with the inner-conductor-containing holes 2*a* and 2*f*. The inner-conductor-containing holes are used as trap resonators.

The trap resonators would provide an increased attenuation characteristic at the boundary of the pass band, thereby improving the capability of the dielectric duplexer in addition to the aforementioned advantages. The trap resonator on the transmission filter side exhibits a sharp drop in the amount of transmission from the transmission frequency pass band to the reception frequency band. A trap resonator on the reception filter side exhibits a sharp drop in the amount of transmission from the reception frequency pass band to the transmission frequency band.

Either the trap resonator on the transmission filter side or the trap resonator on the reception filter side may be provided.

In FIGS. 1 to 3, the short circuited electrode 10 is formed on the inner surface of the through-hole 9. Instead of the through-hole 9, a conductor such as an electrode film or a metal bar may be embedded in the dielectric block 1 in order to electrically short circuit both surfaces.

A dielectric duplexer according to a second embodiment of the present invention is described with reference to FIGS. 5 and 6.

Figure 5A:
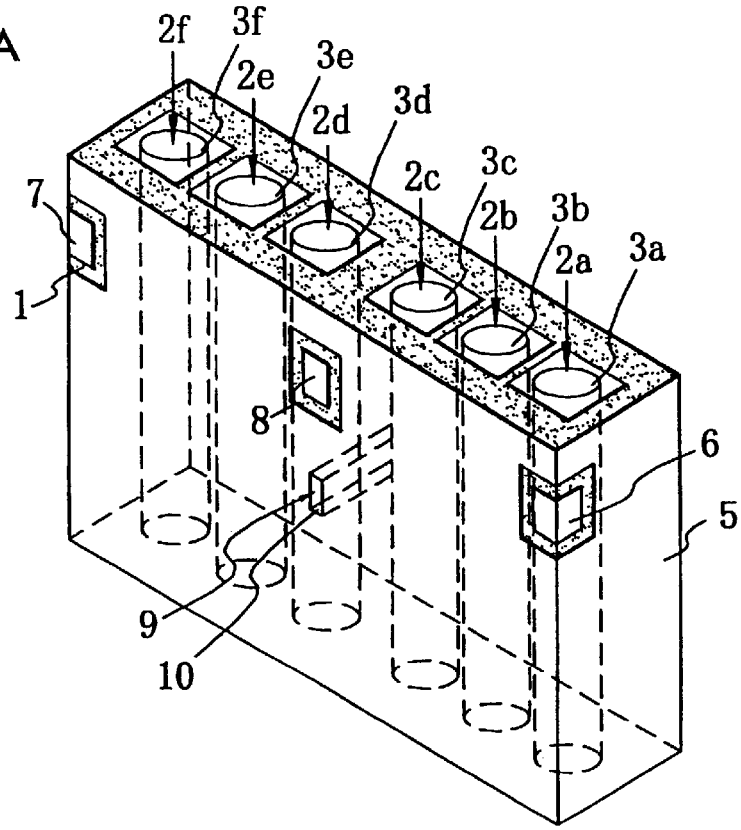
FIG. 5A and 5B is a perspective view of the appearance of a dielectric duplexer according to a second embodiment of the present invention.
Figure 5B:
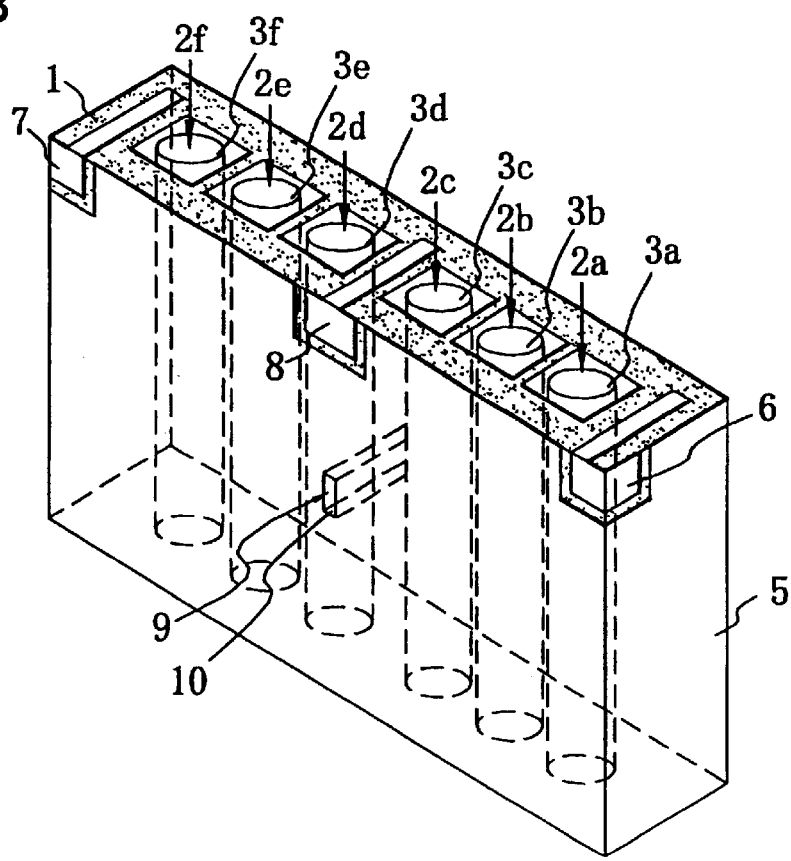

FIGS. 5A and 5B are perspective views of the appearance of two different types of dielectric duplexers. FIG. 5A shows a dielectric duplexer having input/output electrodes formed on the mounting surface and on the end surfaces in the alignment direction of the inner-conductor-containing holes 2*a* to 2*f*. FIG. 5B shows a dielectric duplexer having input/output electrodes formed on the mounting surface, the end surfaces in the alignment direction of the inner-conductor-containing holes 2*a* to 2*f*, and on the open surface of the inner-conductor-containing holes 2*a* to 2*f*.

Figure 6:
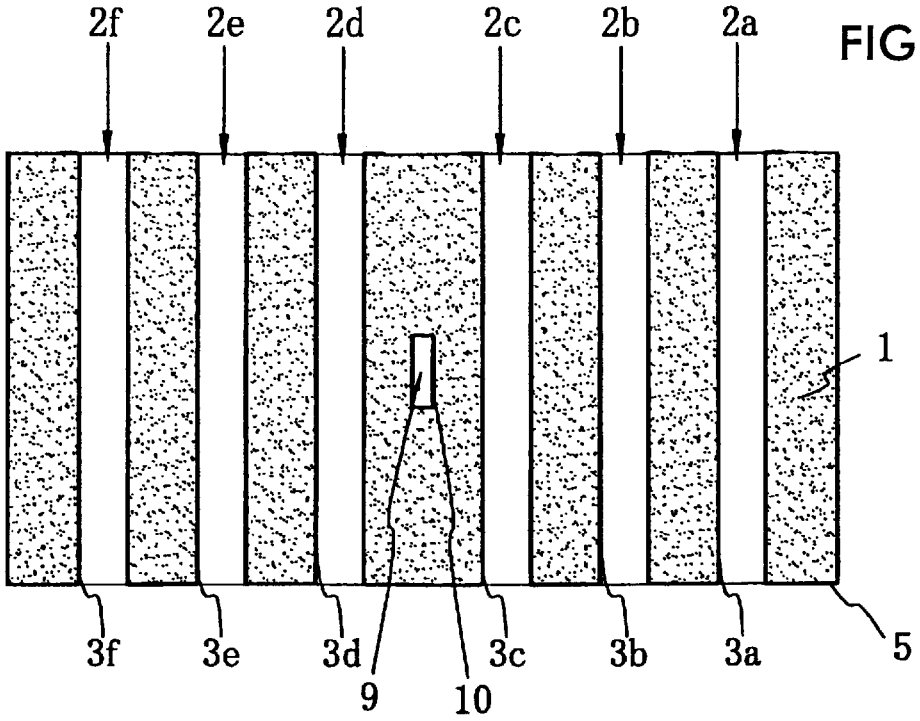
FIG. 6 is a cross-sectional view of the dielectric duplexer shown in FIG. 5.

FIG. 6 is a cross-sectional view of the dielectric duplexer shown in FIG. 5A.

Referring to FIGS. 5A and 6, a substantially rectangular dielectric block 1 includes inner-conductor-containing holes 2*a* to 2*f* having inner conductors 3*a* to 3*f* formed on the inner surfaces thereof, respectively, and an outer conductor 5 formed on the outer surface thereof except for one surface where the inner-conductor-containing holes 2*a* to 2*f* are formed, i.e., on five surfaces. The surface where the inner-conductor-containing holes 2*a* to 2*f* are formed includes electrodes in the vicinity of the openings of the inner-conductor-containing holes 2*a* to 2*f*, and that surface is open. The other surface opposite thereto where the inner-conductor-containing holes 2*a* to 2*f* are formed is short circuited. Thus, dielectric resonators are constructed.

On the outer surface of the dielectric block 1, input/output electrodes 6 and 7 which are separated from the outer conductor 5 are formed so as to extend from the end surfaces in the alignment direction of the inner-conductor-containing holes 2*a* to 2*f* to the mounting surface which faces the mounting substrate. On the outer surface of the dielectric block 1, an input/output electrode 8 which is separated from the outer conductor 5 is further formed between the inner-conductor-containing holes 2*c* and 2*d* on the mounting surface in the vicinity of the open surface of the inner-conductor-containing holes 2*a* to 2*f*. With this structure, a first group of the inner-conductor-containing holes 2*a* to 2*c*, and a second group of the inner-conductor-containing holes 2*d* to 2*f* each form a three-stage comb-line dielectric filter. The input/output electrode 6 is capacitively coupled with the inner conductor 3*a*, and the input/output electrode 7 is capacitively coupled with the inner conductor 3*f*. The input/output electrode 8 is capacitively coupled with the inner conductor 3*c* and 3*d*. Therefore, a dielectric duplexer is formed as a whole.

A through-hole 9 having a short circuited electrode 10 formed on the inner surface thereof is provided in the center between the inner-conductor-containing holes 2*c* and 2*d* so as to run from the mounting surface to the surface opposite thereto.

In the thus constructed dielectric duplexer, as in the first embodiment, the lowest resonant frequency in a TE mode is shifted to a higher frequency region, resulting in reduced spurious responses.

The dielectric duplexer shown in FIG. 5B includes input/output electrodes 6 and 7 which are formed so as to extend from the mounting surface to the end surfaces in the alignment direction of the inner-conductor-containing holes 2*a* and 2*f* and to the open surface of the inner-conductor-containing holes 2*a* to 2*f*. The dielectric duplexer further includes an input/output electrode 8 which is formed so as to extend from the mounting surface to the open surface of the inner-conductor-containing holes 2*a* to 2*f*. The structure of other components is the same as that in the dielectric duplexer shown in FIG. 5A. In the thus constructed dielectric duplexer shown in FIG. 5B, as in the first embodiment, the lowest resonant frequency in a TE mode is shifted to a higher frequency region, resulting in reduced spurious responses.

A dielectric duplexer according to a third embodiment of the present invention is described with reference to FIGS. 7 and 8.

Figure 7:
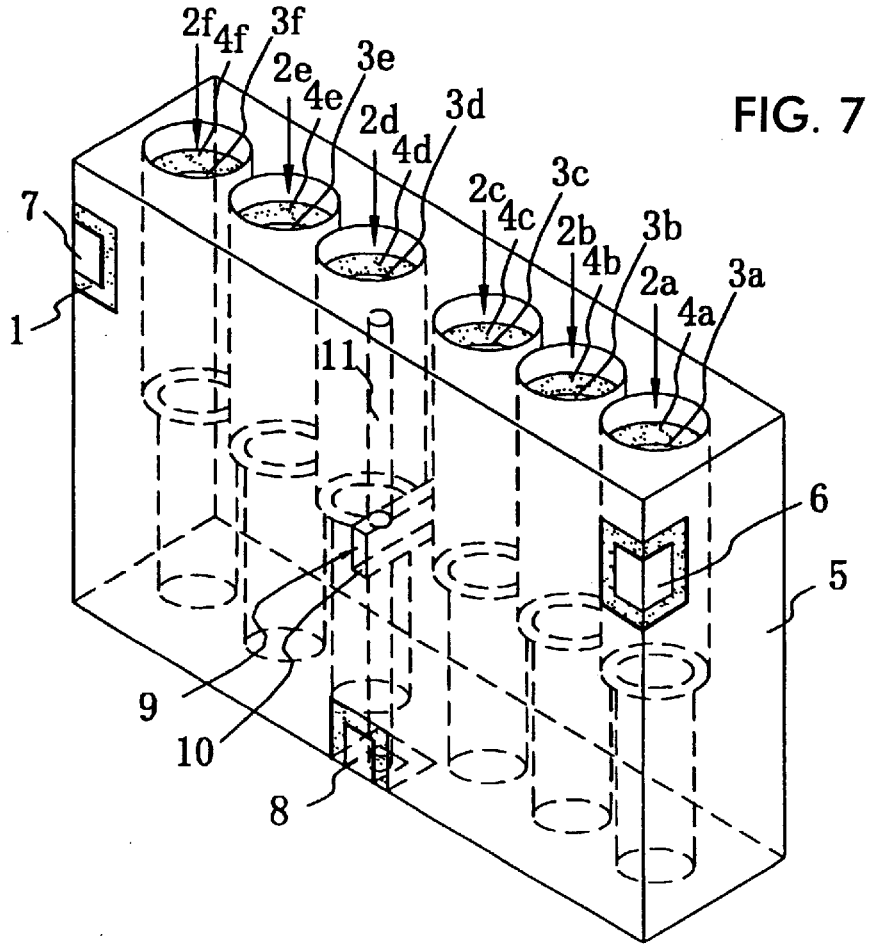
FIG. 7 is a perspective view of the appearance of a dielectric duplexer according to a third embodiment of the present invention.
Figure 8A:
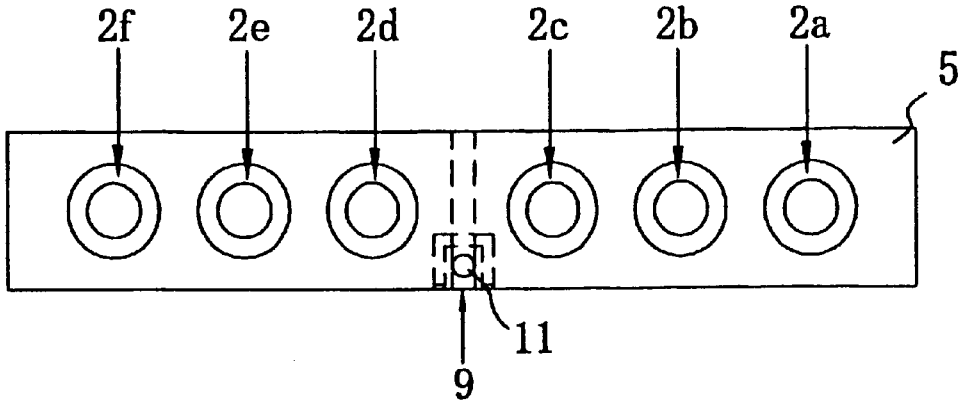
FIGS. 8A and 8B are a top view and a cross-sectional view of the dielectric duplexer shown in FIG. 7, respectively.
Figure 8B:
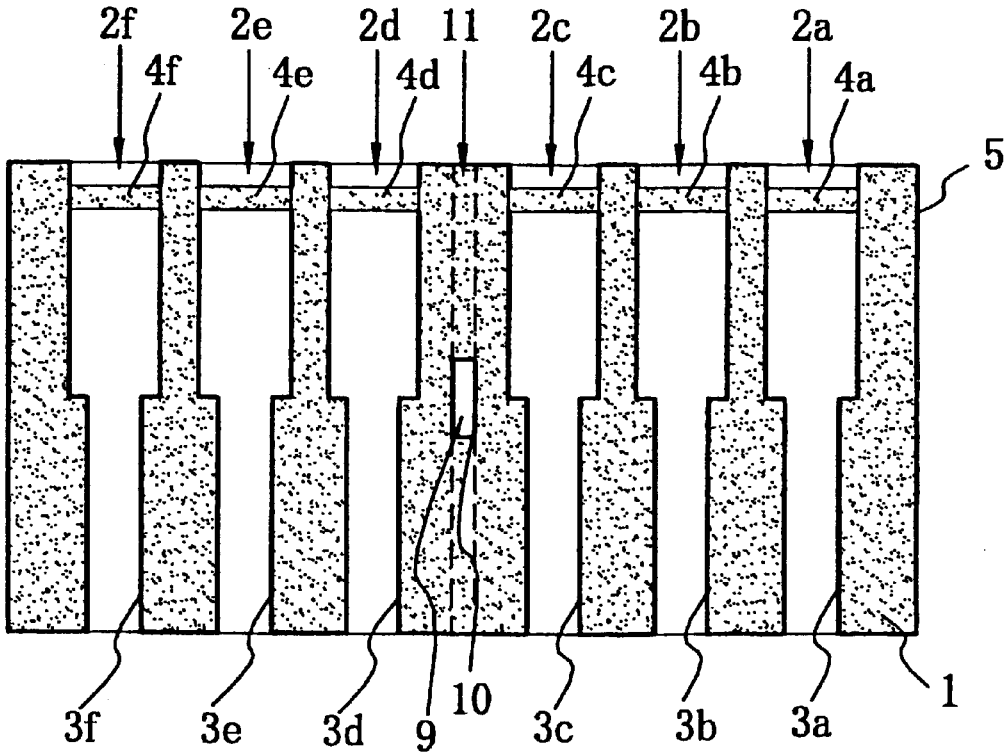

FIG. 7 is a perspective view of the appearance of the dielectric duplexer, and FIGS. 8A and 8B are a top view and a cross-sectional view of the dielectric duplexer shown in FIG. 7, respectively.

The dielectric duplexer shown in FIG. 7 includes an excitation hole 11 for an antenna (hereinafter simply referred to "excitation hole") which penetrates through the input/output electrode 8 and which penetrates through the dielectric block 1 in parallel to the inner-conductor-containing holes 2*a* to 2*f*. The input/output electrode 8 extends from the mounting surface to the open surface in which the short circuited ends of the inner-conductor-containing holes 2*a* to 2*f* are formed. The structure of the other components is the same as that in the dielectric duplexer according to the first embodiment. With this structure, the input/output electrodes 6 and 7 are capacitively coupled with the inner conductors 3*a* and 3*f*, respectively. The input/output electrode 8 is interdigitally coupled with the inner conductors 3*c* and 3*d* through the excitation hole 11, resulting in magnetic field coupling.

In the thus constructed dielectric duplexer, the through-hole 9 having a short circuited electrode 10 formed on the inner surface thereof intersects the excitation hole 11.

With this structure, as in the first embodiment, the lowest resonant frequency in a TE mode is shifted to a higher frequency region, resulting in reduced spurious responses.

If the input/output electrode 8 is formed on the open surface where the open ends of the inner-conductor-containing holes 2*a* to 2*f* are formed, the excitation hole 11 may be combline-coupled with the inner conductors 3*c* and 3*d*, resulting in magnetic field coupling. This structure would take the same advantages as those in the first embodiment.

A dielectric duplexer shown in FIGS. 9A and 9B would take the same advantages.

FIG. 9A is a perspective view of the appearance of a modified dielectric duplexer according to the third embodiment, and FIG. 9B is a cross-sectional view of the dielectric duplexer shown in FIG. 9A.

As in the dielectric duplexer shown in FIG. 7, the dielectric duplexer shown in FIGS. 9A and 9B includes a through-hole 9 having a short circuited electrode 10 formed on the inner surface thereof which runs from the mounting surface of the dielectric block 1 to the surface opposite thereto. Unlike the dielectric duplexer shown in FIG. 7, however, the through-hole 9 does not intersect the excitation hole 11. The structure of the other components is the same as that in the dielectric duplexer shown in FIGS. 7 and 8A and 8B.

With this structure, as in the first embodiment, the lowest resonant frequency in a TE mode is shifted to a higher frequency region, resulting in reduced spurious responses. Since the through-hole 9 does not intersect the excitation hole 11, it does not functionally affect the excitation hole 11. However, the dielectric duplexer shown in FIG. 7 can have a narrower width than the dielectric duplexer shown in FIG. 9 by the width of the through-hole 9. Thus, the dielectric duplexer shown in FIG. 7 may be more compact.

The dielectric duplexer according to the third embodiment shown in FIGS. 7 to 9 may include excitation holes formed at outer positions than the outermost inner-conductor-containing holes 2*a* and 2*f* so as to be parallel to the outermost inner-conductor-containing holes 2*a* and 2*f*, so that a transmission signal input unit or a reception signal output unit is externally coupled through the excitation holes.

Although the through-hole 9 has a rectangular shape in cross-section in the first to third embodiments, the through-hole 9 is not limited to this shape. A through-hole having a circular, elliptic, or polygonal cross section would take the same advantages.

A communication apparatus according to a fourth embodiment of the present invention is described with reference to FIG. 10.

Figure 10:
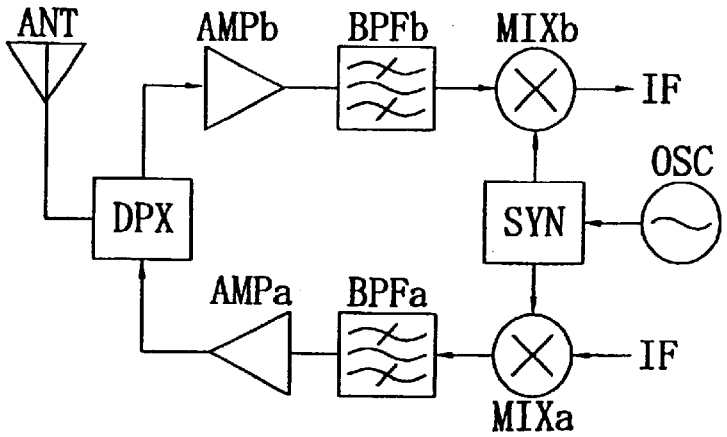
FIG. 10 is a block diagram of a communication apparatus according to a fourth embodiment of the present invention.
Figure 11:
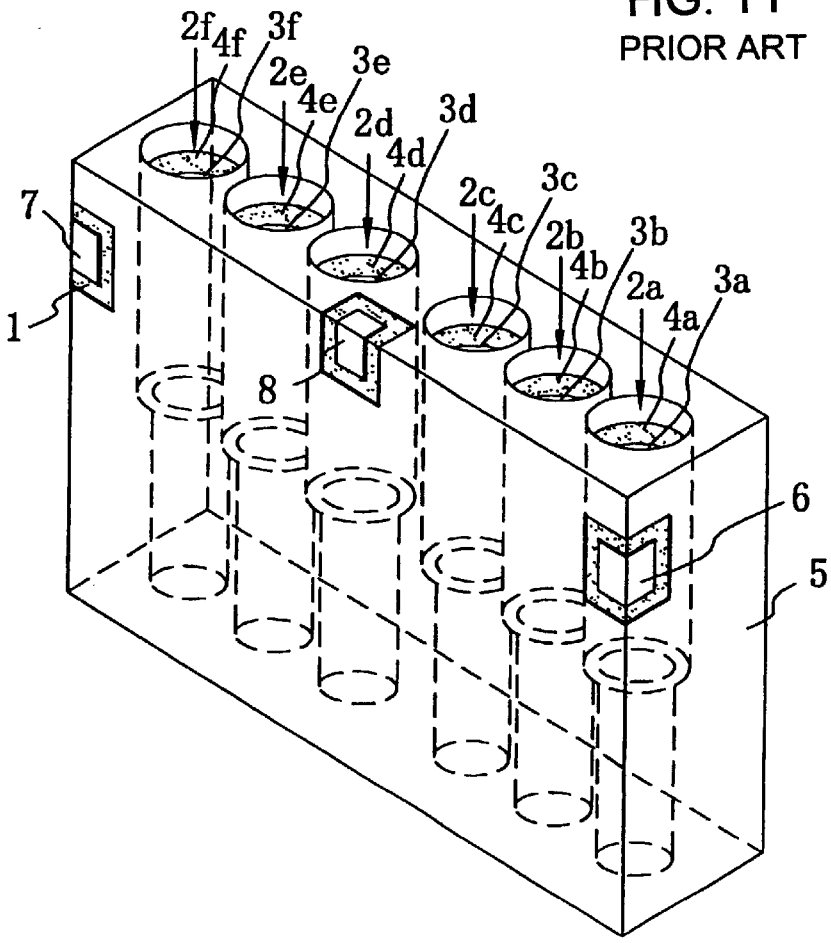
FIG. 11 PRIOR ART
FIG. 11 is a perspective view of the appearance of a typical dielectric duplexer.

FIG. 10 is a block diagram of the communication apparatus.

In FIG. 10, the communication apparatus includes a transmission/reception antenna ANT, a duplexer DPX, band-pass filters BPFa and BPFb, amplifier circuits AMPa and AMPb, mixers MIXa and MIXb, an oscillator OSC, and a synthesizer SYN. An intermediate frequency signal to be transmitted or received is indicated by IF. The mixer MIXa modulates an intermediate frequency signal output from the synthesizer SYN with the IF signal, and the band-pass filter BPFa passes only the transmission frequency band signal. The resulting signal is amplified by the amplifier circuit AMPa, and is then transmitted from the antenna ANT via the duplexer DPX. The amplifier circuit AMPb amplifies the signal output from the duplexer DPX. The band-pass filter BPFb passes only the reception frequency band signal in the signal output from the amplifier circuit AMPb. The frequency signal output from the band-pass filter BPFb is mixed with a reception signal by the mixer MIXb to output an intermediate frequency signal IF.

The duplexer DPX shown in FIG. 10 may be implemented as the dielectric duplexer having any structure as described with respect to FIGS. 1 to 9. The communication apparatus incorporating such a compact dielectric duplexer having low spurious responses would be compact and highly efficient with predetermined communication performance.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric duplexer comprising:

a dielectric block;

a plurality of inner-conductor-containing holes formed in the dielectric block, each hole having an inner conductor formed on the inner surface thereof, the inner-conductor-containing holes extending from one surface to another surface opposite thereto of the dielectric block;

an outer conductor and an input/output terminal which are formed on the outer surface of the dielectric block, the input/output terminal being separated from the outer conductor; and at least one short circuited conductor formed between the plurality of inner-conductor-containing holes on a transmitter side and the plurality of inner-conductor-containing holes on a receiver side, said at least one short circuited conductor extending from one surface that is parallel to the axes of the inner-conductor-containing holes to another surface opposite thereto and conductively coupled to said outer conductor at both ends thereof.

2. A communication apparatus comprising a dielectric duplexer according to claim 1.

3. A dielectric duplexer according to claim 1, wherein said dielectric block is a substantially rectangular block.

4. A dielectric duplexer comprising:

a dielectric block;

a plurality of inner-conductor-containing holes formed in the dielectric block, each hole having an inner conductor formed on the inner surface thereof, the inner-conductor-containing holes extending from one surface to another surface opposite thereto of the dielectric block;

an outer conductor and an input/output terminal which are formed on the outer surface of the dielectric block, the input/output terminal being separated from the outer conductor; and at least one short circuited conductor formed between the plurality of inner-conductor-containing holes on a transmitter side and the plurality of inner-conductor-containing holes on a receiver side, said at least one short circuited conductor extending from one surface that is parallel to the axes of the inner-conductor-containing holes to another surface opposite thereto and conductively coupled to said outer conductor, wherein said dielectric block includes an excitation hole for an antenna, and said at least one short circuited conductor intersects said excitation hole.

5. A dielectric duplexer according to claim 4, wherein said dielectric block is a substantially rectangular block.

6. A communication apparatus comprising a dielectric duplexer according to claim 4.

* * * * *